US007134722B2

(12) United States Patent
Ueda et al.

(10) Patent No.: US 7,134,722 B2
(45) Date of Patent: Nov. 14, 2006

(54) CHAIR

(75) Inventors: Nobuyuki Ueda, Osaka (JP); Yojiro Kinoshita, Osaka (JP); Toshiyuki Horiki, Nagano (JP); Toru Aoyagi, Nagano (JP)

(73) Assignees: Kokuyo Co., Ltd., Osaka (JP); Takano Co., Ltd., Nagano (JP)

( * ) Notice: Subject to any disclaimer, the term of this patent is extended or adjusted under 35 U.S.C. 154(b) by 2 days.

(21) Appl. No.: 10/340,638

(22) Filed: Jan. 13, 2003

(65) Prior Publication Data

US 2003/0151287 A1 Aug. 14, 2003

(30) Foreign Application Priority Data

Feb. 8, 2002 (JP) ..... P2002-032914
Mar. 29, 2002 (JP) ..... 2002-095943

(51) Int. Cl.
*A47C 1/024* (2006.01)

(52) U.S. Cl. ..... 297/301.1; 297/300.1; 297/300.2; 297/300.7

(58) Field of Classification Search ..... 297/300.1, 297/284.4, 300.2, 300.7, 301.1, 301.5, 302.1, 297/300.5, 452.1, 302.7, 302.6
See application file for complete search history.

(56) References Cited

U.S. PATENT DOCUMENTS 3,241,879 A * 3/1966 Castello et al. ..... 297/284.4
3,762,769 A * 10/1973 Poschl ..... 297/284.4
3,938,858 A * 2/1976 Drabert et al. ..... 297/284.4
4,153,293 A * 5/1979 Sheldon ..... 297/284.4
4,830,430 A * 5/1989 Schafer ..... 297/298
5,553,917 A * 9/1996 Adat et al. ..... 297/230.14
5,984,408 A * 11/1999 Bujaryn ..... 297/323
6,523,898 B1 * 2/2003 Ball et al. ..... 297/320
6,616,228 B1 * 9/2003 Heidmann ..... 297/284.4
6,626,494 B1 * 9/2003 Yoo ..... 297/296
6,695,404 B1 * 2/2004 Bruske ..... 297/316
6,820,935 B1 * 11/2004 Cioncada ..... 297/300.1
6,935,689 B1 * 8/2005 Horiki et al. ..... 297/300.5
6,966,604 B1 * 11/2005 Stumpf et al. ..... 297/300.2

FOREIGN PATENT DOCUMENTS

GB 2112277 A * 7/1983

* cited by examiner

*Primary Examiner*—Peter M. Cuomo
*Assistant Examiner*—Erika Garrett
(74) *Attorney, Agent, or Firm*—Banner & Witcoff, Ltd.

(57) ABSTRACT

A simple arrangement of a chair allows transformation of the shape of a backrest. The chair has a transformable backrest and a backrest receiving member that supports a bottom end portion of the backrest in a slidable manner toward a certain direction and an operating lever to select and fix a position at which the backrest is slid and the backrest can be transformed in compliance with the position fixed by the operating lever.

10 Claims, 19 Drawing Sheets

CHAIR

CROSS REFERENCE TO RELATED APPLICATIONS

This application is based upon and claims the benefit of priority from the prior Japanese Patent Application Nos. P2002-32914, filed Feb. 8, 2002, and P2002-95943, filed Mar. 29, 2002, the entire contents of which are incorporated herein by reference.

BACKGROUND OF THE INVENTION AND RELATED ART STATEMENT

This invention relates to a chair that effectively improves comfortability to sit on with a simple arrangement.

For a chair whether it is comfortable to sit on or not is one of major factors affecting a body of a seated person or a working efficiency and this is the most important fundamental function as a chair. Then chairs have been highly functioned in a multilateral manner to improve comfortability to sit on through varieties of mechanisms such as backrest reclining, back and seat rocking or lumber support.

Viewed from a point of a lumber support function, there have been some lumber support functions that can adjust a position of the lumber support. A position of a lumber of a human or a way to sit differs depending on individual specificity such as a gender, an age, or physical attributes. Then that a position of the lumber support can be adjusted is very effective especially for a chair manufactured in a standardized manner in terms of fitting the chair to varieties of users.

A conventionally conceived mechanism is superior functionally, however, it is complicated such that a lumber support member is embedded inside the backrest movably in an operable manner from outside and then the lumber support member is operated so as to push the backrest, which makes a face of the backrest projected or depressed.

Due to this arrangement, it is difficult for a simple-type chair to adopt the mechanism unless the chair has an arrangement in which backrest is thick enough to allow increment of a member of the mechanism to be embedded.

SUMMARY OF THE INVENTION

In order to incorporate the above function chiefly into simple-type chairs, the present claimed invention intends to provide a chair comprising a backrest wherein the backrest is made transformably, and further comprising a backrest supporting portion that supports at least either a top end portion or a bottom end portion of the backrest in a slidable manner toward a certain direction and an operating portion that selects and fixes a position at which the backrest is slid wherein the backrest can be transformed in compliance with the position fixed by the operating portion.

The backrest may be transformed by making use of flexible transformation of the backrest itself. In this case, a portion which is transformed, in other words, a position, a size or a range on the whole of the backrest can be set variously in accordance with an object or a usage to transform or a material characteristic of the backrest.

In accordance with the arrangement, since the backrest is given elasticity and a part of the backrest is supported under a sliding structure by the backrest support portion, it is possible to simplify an arrangement to support the backrest. Especially, if the backrest is given elasticity, feeling to contact or feeling to use the backrest can be improved, therefore there is no need of furnishing additional arrangement to secure the feeling. As a result, in accordance with this invention, a structure that functions as a backrest and a structure that is necessary to transform the backrest can be effectively combined.

As concrete embodiments, followings are represented.

1) A chair wherein the top end portion of the backrest is supported in a rotatable manner around a horizontal axis, and the bottom end portion of the backrest is supported in a slidable manner by a backrest bottom supporting portion and a position at which the bottom end portion of the backrest is slid can be selected and fixed by a bottom operating portion.
2) A chair wherein the bottom end portion of the backrest is supported in a slidable manner by a backrest bottom supporting portion and a position at which the bottom end portion of the backrest is slid can be selected and fixed by a bottom operating portion, and the top end portion of the backrest is supported in a slidable manner by a backrest top supporting portion and a position at which the top end portion of the backrest is slid can be selected and fixed by a top operating portion.
3) A chair wherein the top end portion of the backrest is fixed and the bottom end portion of the backrest is supported in a slidable manner by a backrest bottom supporting portion and a position at which the bottom end portion of the backrest is slid can be selected and fixed by a bottom operating portion. A meaning of the above word "fixed" includes "fixed firmly" and "fixed in a condition at which a certain level of a bumpy condition is allowed" (for example, fixed by means of a pivot)"
4) A chair wherein the bottom end portion of the backrest is supported in a rotatable manner around a horizontal axis and the top end portion of the backrest is supported in a slidable manner by a backrest top supporting portion and a position at which the top end portion of the backrest is slid can be selected and fixed by a top operating portion.
5) A chair wherein the bottom end portion of the backrest is fixed and the top end portion of the backrest is supported in a slidable manner by a backrest top supporting portion and a position at which the top end portion of the backrest is slid can be selected and fixed by a top operating portion. A meaning of "fixed" is the same as that described in the above 3).

In the above a sliding movement toward a predetermined direction may be either a movement along a line or a movement along an arc.

A preferable modified embodiment of the backrest may be represented by the backrest that transforms with the position of the lumber support projected or depressed back and forth in compliance with the position operated by the operating portion or the backrest that transforms with the position of the lumber support projected or depressed back and forth or up and down in compliance with the position operated by the operating portion.

Another modified embodiment of the backrest may be a backrest that transforms its shape of S-curve smoothly in compliance with the position operated by the operating portion.

As a suitable arrangement of a backrest it is preferable that a backrest comprises a transformable backrest body that locates at a position that contacts a back of a seated person and a backrest reinforcing member that supports a part of the backrest body from its back side wherein a portion that is not supported by the backrest reinforcing member can be transformed.

DETAILED DESCRIPTION OF THE PREFERRED EMBODIMENTS

A first embodiment of the invention will be described in detail with reference to the accompanying drawings.

Figure 1:
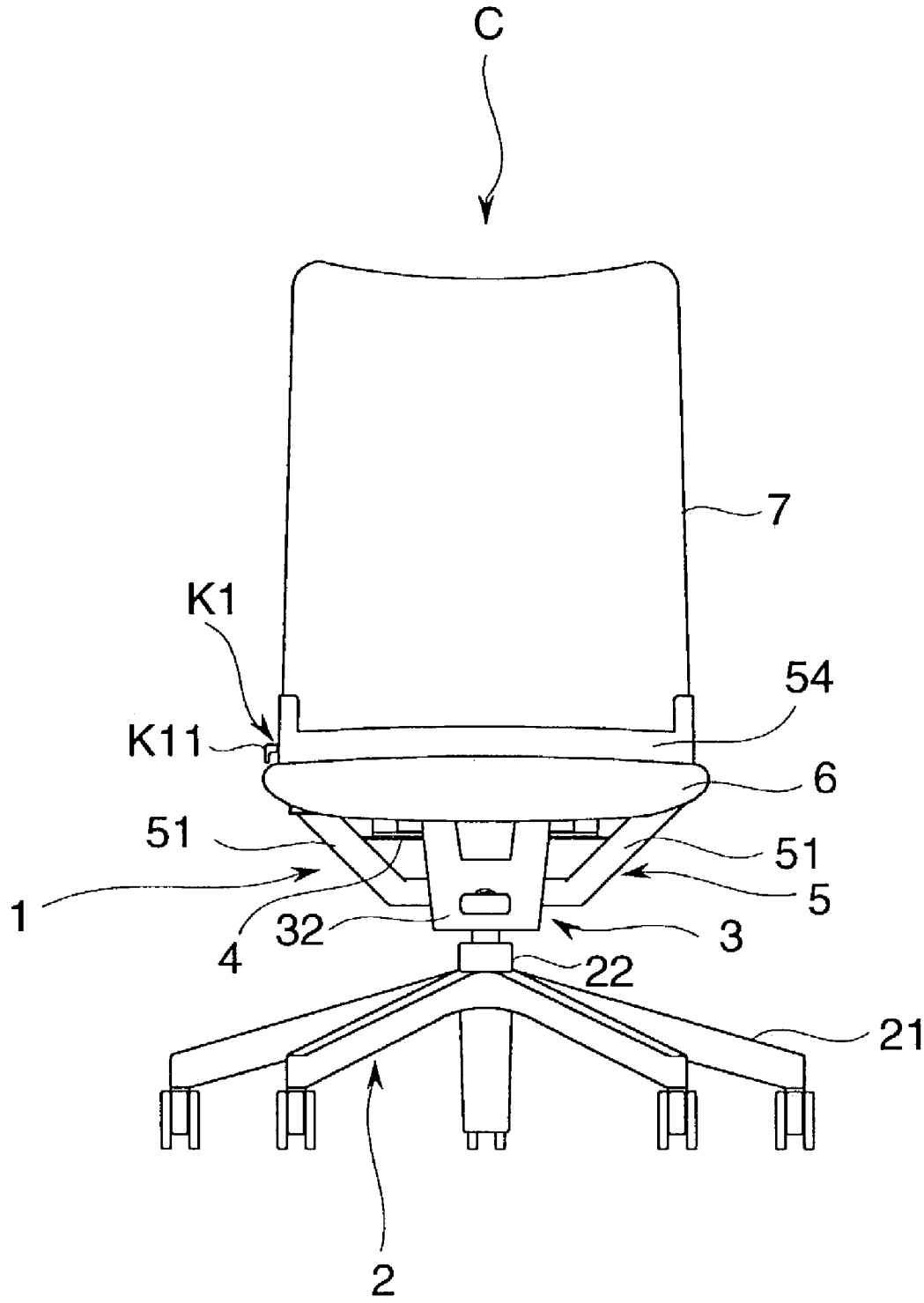
FIG. 1 is a front view of a chair in accordance with the first embodiment of the invention.
Figure 2:
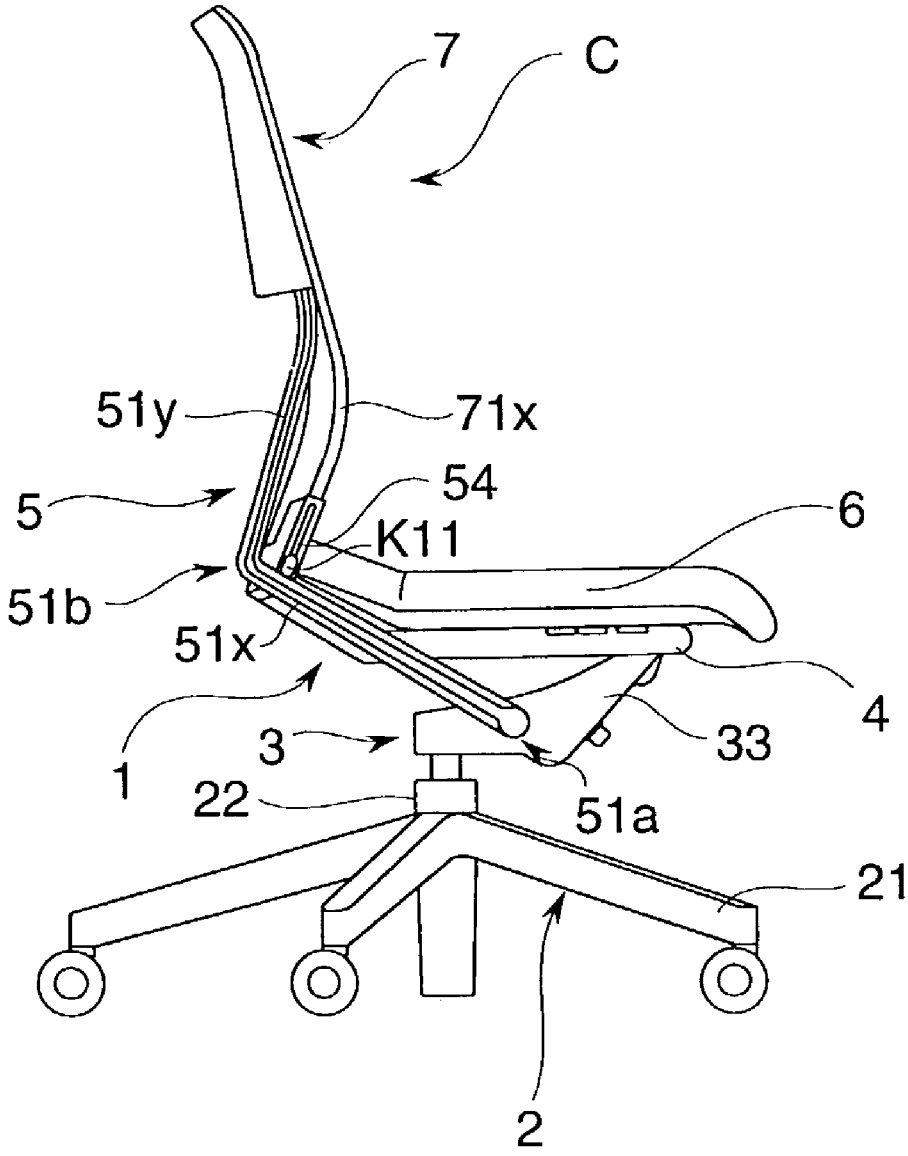
FIG. 2 is a left side view of the embodiment.
Figure 3:
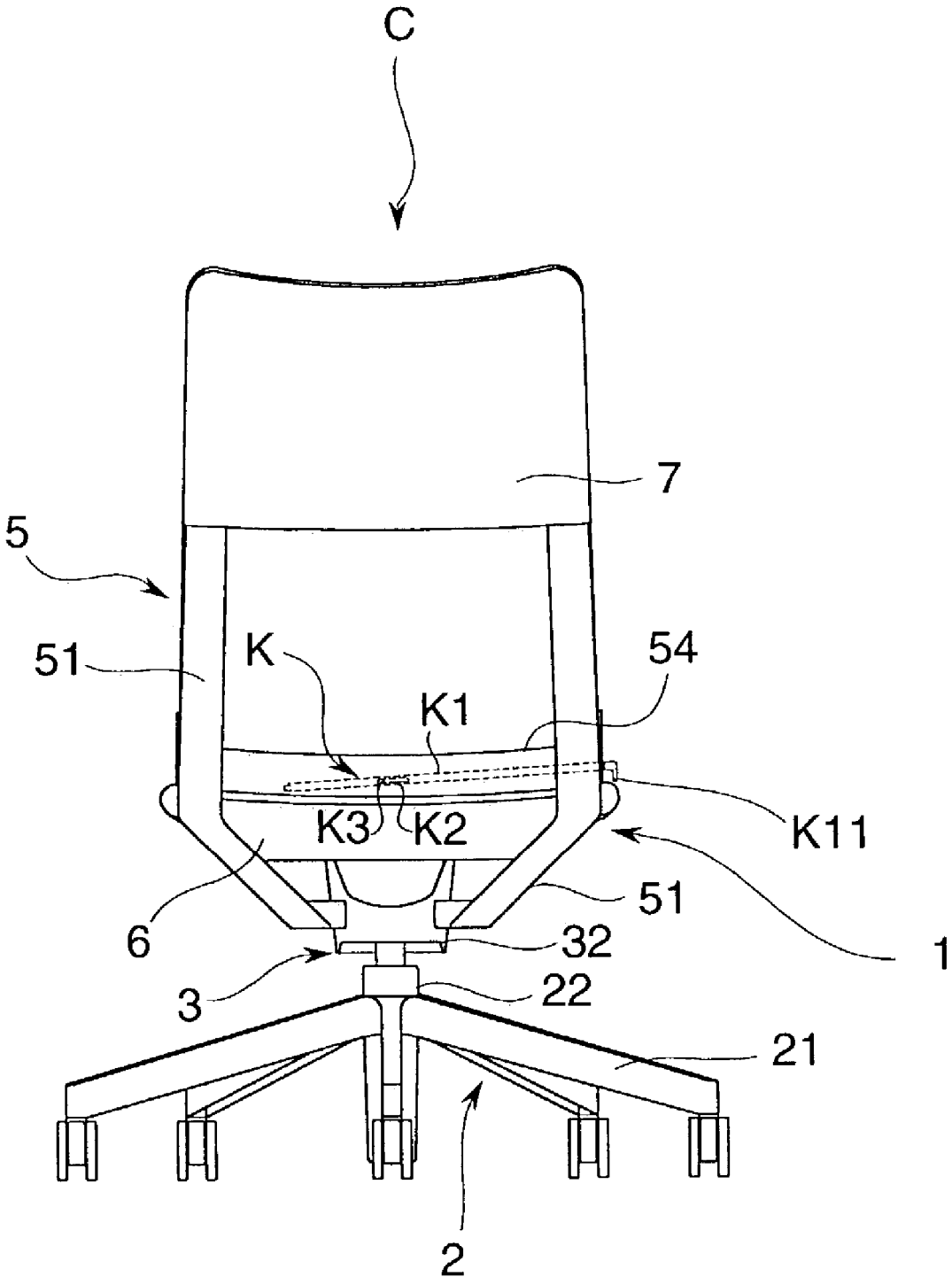
FIG. 3 is a back view of the embodiment.

A chair C of this embodiment is, as shown in FIG. 1 through FIG. 3, so arranged that a body 1 as a base of a structure comprises a leg 2, a supporting base 3 mounted on a top end of the leg 2, a seat frame 4 whose front is supported by the supporting base 3 and a back frame 5 whose proximal end is mounted on the supporting base 3 and whose middle portion supports a rear portion of the seat frame 4, in which a seat 6 is mounted on the seat frame 4 and a backrest 7 is mounted on the back frame 5.

First, the body 1 will be explained.

The leg 2 is so constructed that a supporting post 22 stands at a center of five leg wings 21 and that the supporting post 22 can move up and down and into which a gas spring mechanism, not shown in drawings, is incorporated.

Figure 4:
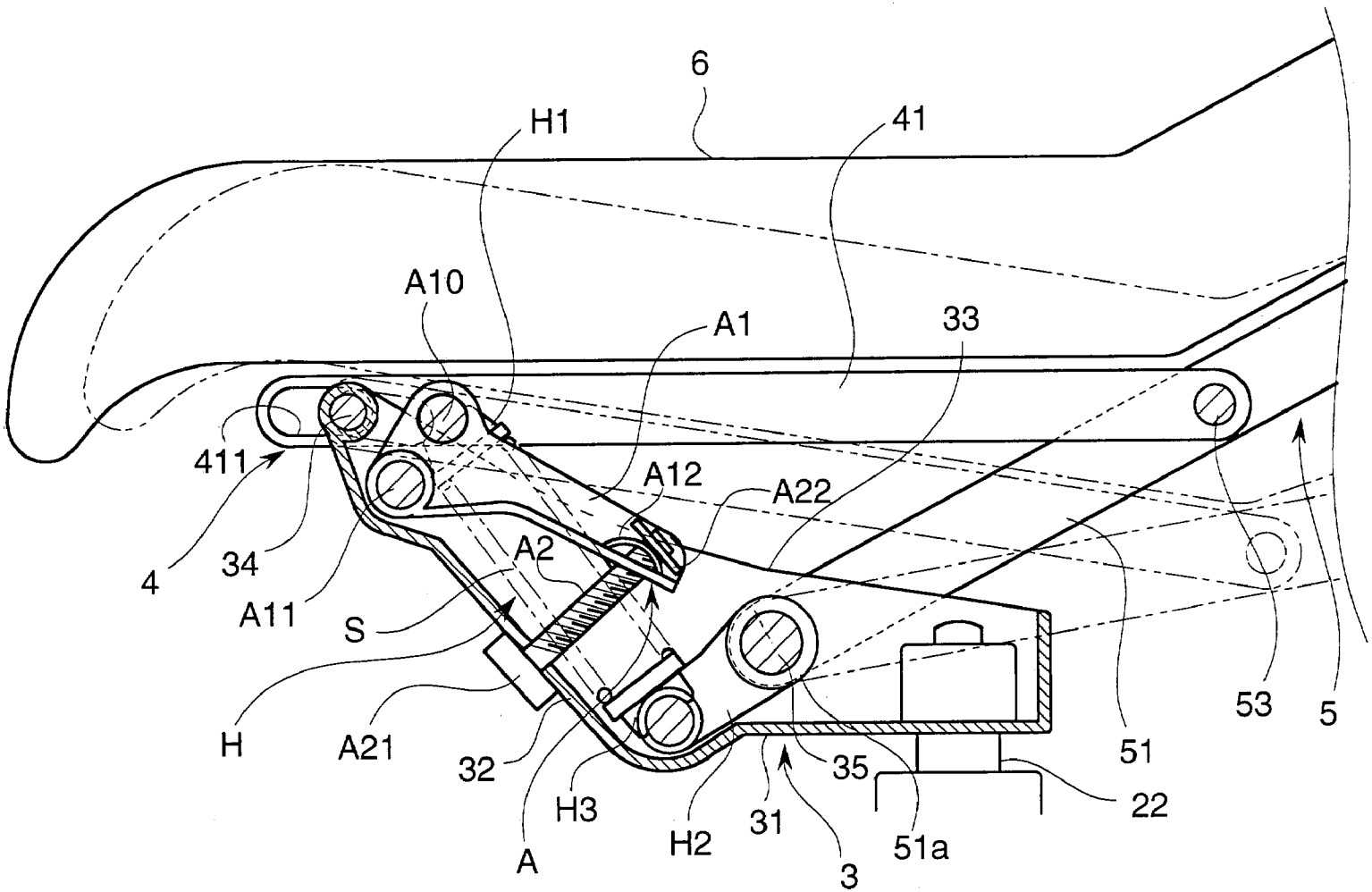
FIG. 4 is a magnified longitudinal cross-sectional view showing around a supporting base of the embodiment.

The supporting base 3 is mounted in a rotatable manner on the top end portion of the supporting post 22 and is generally boat form as shown in FIG. 4, comprising a bottom wall 31 that extends forward horizontally and a part of which the supporting post 22 penetrates vertically, a front wall 32 that stands inclining forward from a front end of the bottom wall 31 and a side wall 33 that stands from a circumference of the bottom wall 31 and the front wall 32 so as to form a mechanism store space opening upward together with the bottom wall 31 and the front wall 32. The supporting base 3 has an arrangement in which a pair of front seat frame mounting axes 34 are integrally provided to project or externally mounted with its axis coincided each other. A back mounting axis 35 penetrates the supporting base 3 with crossing the right and left side walls 33 at a position that traverses above the bottom wall 31.

Figure 5:
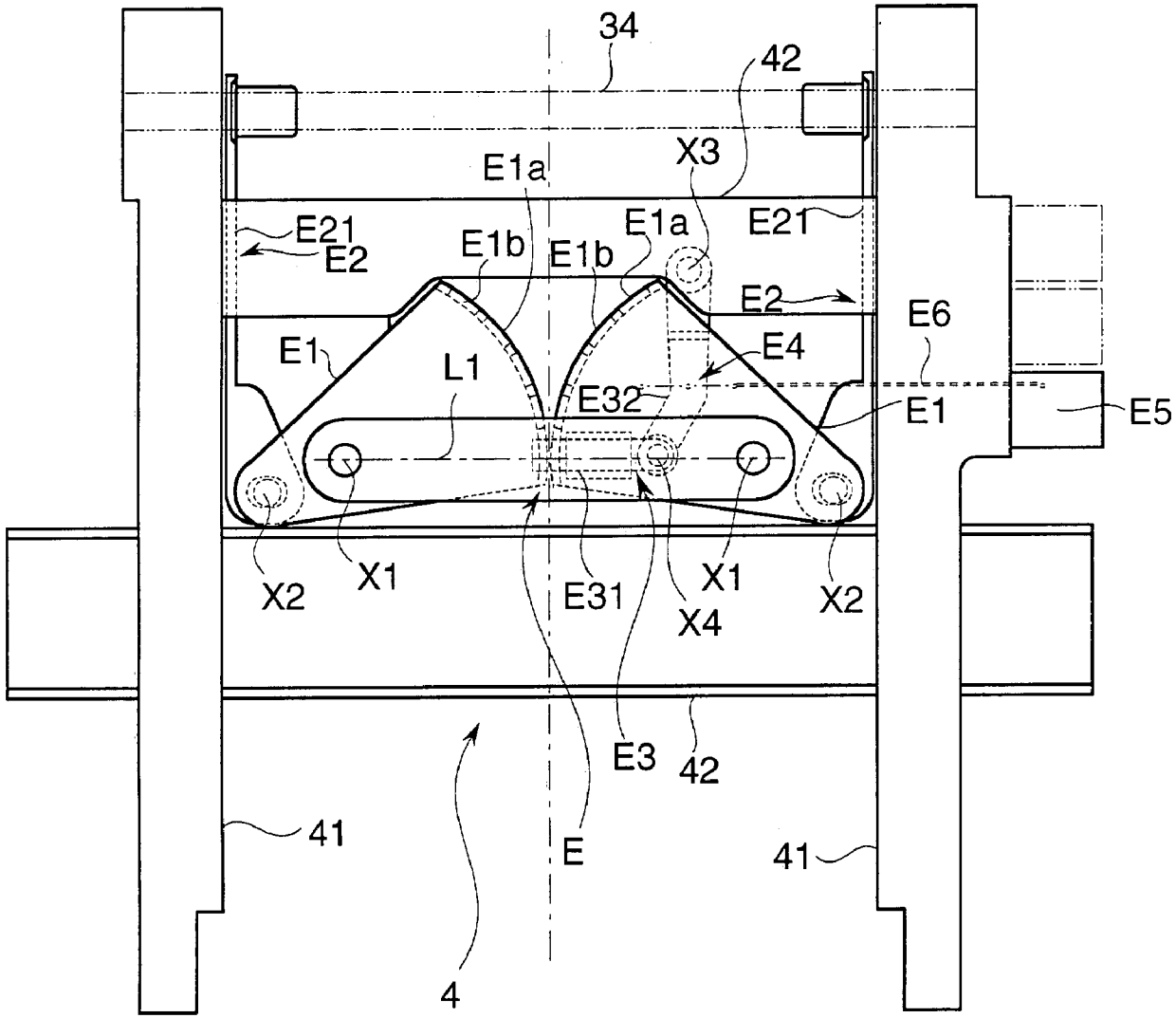
FIG. 5 is a plane view showing a seat frame of the chair provided with a rocking mechanism in accordance with the embodiment.
Figure 6:
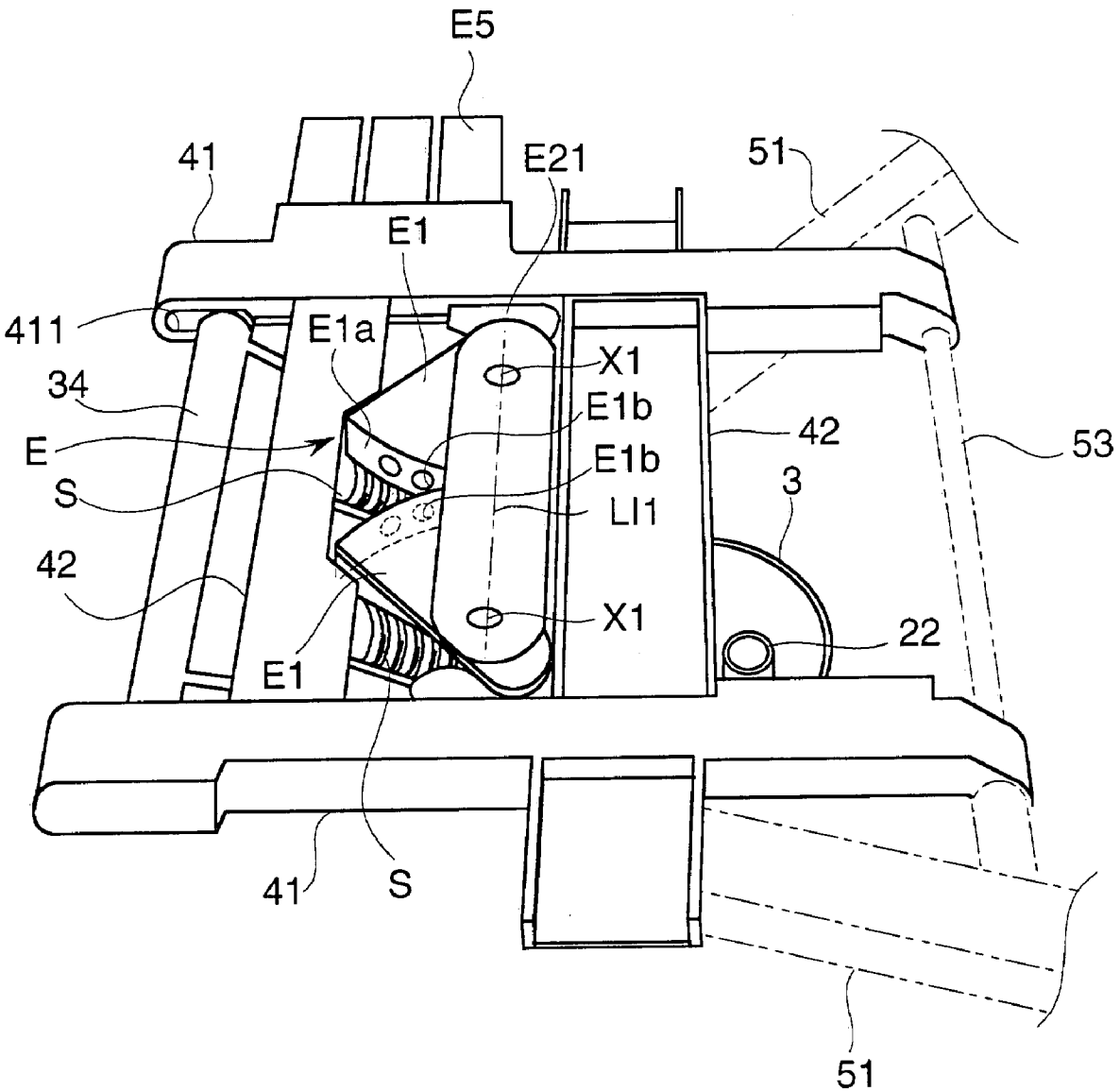
FIG. 6 is an exploded perspective view of the seat frame from which a seat is dismounted in accordance with the embodiment.

The seat frame 4, whose plane view is shown in FIG. 5 and whose perspective view in a state wherein the seat frame 4 is mounted on the supporting base 3 is shown in FIG. 6, locates above the supporting base 3 and is in a double cross shape comprising longitudinal frames 41 extending back and forth in parallel at a predetermined interval and transversal frames 42 connecting the longitudinal frames 41 at a near front end portion and a near rear end portion. Each of the longitudinal frames 41 is provided with a long hole 411 respectively at an appropriate position and an end of the front seat frame mounting axis 34 of the supporting base 3 is inserted into the long holes 411 in a slidable manner.

Figure 9:
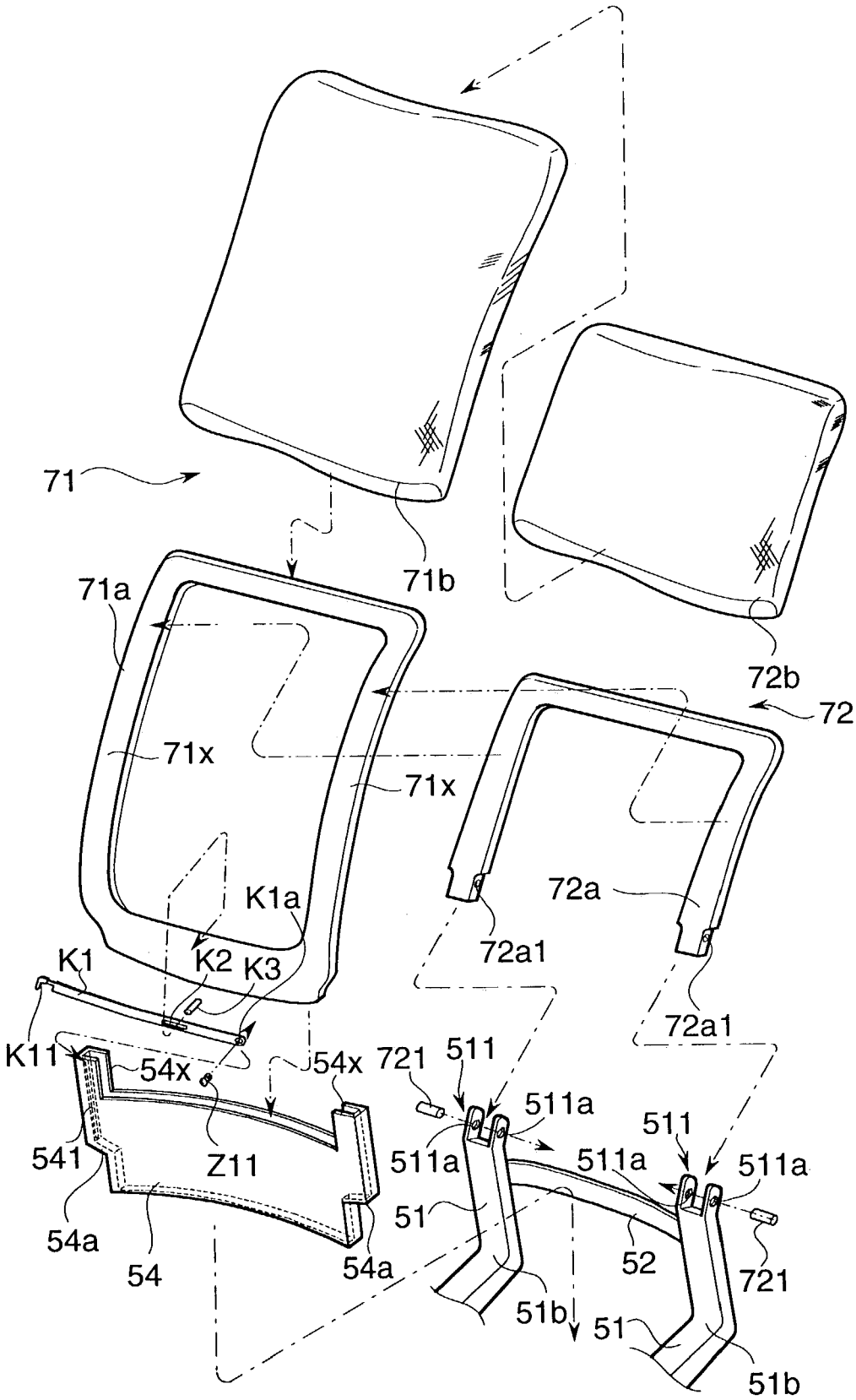
FIG. 9 is an exploded perspective view showing a backrest portion in the embodiment.

The back frame 5 comprises, as shown in FIG. 2, FIG. 3 and FIG. 9, a pair of back frame elements 51 each of which is generally in a shape of "L" and a connecting member 52 that connects near top end portions of the back frame elements 51 at a predetermined interval. The back frame 5 has an arrangement in which a rear seat frame mounting axis 53, as shown in FIG. 4 and FIG. 6, can be mounted between a proximal end 51*a* and a bent portion 51*b* of the back frame element 51. Each of the proximal ends 51*a* of the back frame element 51 is mounted on the back mounting axis 35 of the supporting base 3 in a rotatable manner and a rear portion of the longitudinal frame 41 of the seat frame 4 is mounted on the rear seat frame mounting axis 53 that bridges the back frame elements 51.

With the above arrangement, the body 1 achieves so-called a synchronized tilting mechanism as a whole, as shown in FIG. 4, by positioning the front seat frame mounting axis 34 of the supporting base 3 at a rear end side of the long hole 411 of the seat frame 4 so as to make the chair C take an ordinary use posture in a state wherein the back frame 5 stands up as shown by a solid line in FIG. 4 and by positioning the front seat frame mounting axis 34 of the supporting base 3 at a front end side of the long hole 411 of the seat frame 4 so as to make the chair C take a resting posture with the rear end of the seat frame 4 sunk in a state wherein the back frame 5 tilts rearward as shown by an imaginary line in FIG. 4.

A reactive force mechanism H is incorporated into a part of the synchronized tilting mechanism so as to constitute a rocking mechanism L and further a rocking position fixing mechanism E to fix a rocking movement at a predetermined position and a reactive force adjusting mechanism A to adjust a hardness of a rocking movement are added to the rocking mechanism L as a component.

The reactive force mechanism H comprises, as shown in FIG. 4 and FIG. 6, a pair of coil springs S arranged in a mechanism store space in a backward tilting posture (generally 45 degrees) and whose front top end is supported by a fixing retainer H1 and a first rotating arm H2 that locates above the back mounting axis 35 and rotates in synchronization with a tilting movement of the back frame 5 and a movable retainer H3 that is mounted on an axis displaced from the back mounting axis of the first rotating arm H2. The reactive force mechanism H has an arrangement in which a rear bottom end of the coil spring S is supported by the movable retainer H3 and the movable retainer H3 compresses the coil spring S through the first rotating arm H2 accompanying with a rearward tilting movement of the back frame 5. The first arm H2 locating between a pair of coil springs S is omitted to draw in FIG. 6.

The rocking position fixing mechanism E, whose plane view is shown in FIG. 5 and whose perspective view in a manner of being mounted on the seat frame 4 is shown in FIG. 6, comprises a pair of fixing plates E1 whose plane view is fan-shaped and a position a little displaced toward a proximal end from a middle portion of which is mounted on the seat frame 4 in a rotatable manner around a first vertical axis X1, a movement converting mechanism E2 that converts a rocking movement of the back frame 5 into a rotating movement in synchronization with a pair of the fixing plates E1 and an operating portion E3 that selectively fixes each of the fixing plates E1. The fixing plate E1, whose cross-sectional view taken along a radial line passing the first vertical axis X1 is a character of "L" facing downward, is provided with a plurality of holes E1*b* opening toward a radial direction and arranged at a predetermined pitch on a cylindrical face E1*a* that is aggregation of a cernuous portion of the "L" character. The holes E1*b* rotate in compliance with a synchronized rotating movement of the fixing plate E1 so as to reach a virtual line L1 connecting the first vertical axes X1 one by one and then the hole E1*b* faces a corresponding hole E1*b* tightly on the virtual line L1. The movement converting mechanism E2 comprises a connecting member E21 as a rigid body whose one end is connected with a proximal end of the fun-shaped fixing plate E1 through an engaging portion X2 that engages a second vertical axis with a horizontal long hole and whose other end is engaged with the front seat frame mounting axis 34 of the supporting base 3. In connection with a rocking movement, the seat frame 4 makes a movement down and rearward relative to the supporting base 3 and the first vertical axis X1 follows the movement of the seat frame 4. Meanwhile, when the seat frame 4 makes a movement down and rearward, the cylindrical face E1*a* of the fan-shaped fixing plate E1 turns rearward around the engaging portion X2 by being pushed by the first vertical axis X1 because the second vertical axis that makes an engagement with the proximal end of the fixing plate E1 is kept at a predetermined position by the supporting base 3 through the connecting member E21. The operating portion E3 comprises a fixing pin E31 that is arranged to make its axis coincide with the virtual line L1 and that can move along the axis, a second rotating arm E32 whose proximal end is mounted in a rotatable manner on the transversal frame 42 of the seat frame 4 through a third vertical axis X3 and whose distal end is connected with the fixing pin E31 through an engaging portion X4 that engages a horizontal long hole with a vertical pin, a spring element E4 that pushes the second rotating arm E32 toward a direction so that the fixing plate E1 passes through the hole E1*b* and a rocking position adjusting operation lever E5 that draws the fixing pin E31 out of the hole E1*b* of the fixing plate E1 by drawing back the second rotating arm E32 against the spring element E4. The rocking position adjusting operation lever E5 is mounted on an appropriate position on a side of the seat frame 4. The spring element E4 and the rocking position adjusting operation lever E5 are connected by a wire E6 shown in FIG. 5.

Merits of the rocking position fixing mechanism E are as follows: Since a periphery of the fixing plate E1 is swung in conjunction with a movement of the seat frame 4, the fixing plates E1 are fixed together by engaging the hole E1*b* with the fixing pin E31 of the fixing plate E1 on the periphery, a movement of the seat frame 4 is halted and the backrest 7 and the seat 6 are fixed at the rocking position, a position at which the seat 6 and the backrest 7 are fixed can be at a short interval in spite the holes E1*b* of the fixing plate E1 are arranged at comparatively big intervals. Since a torque arm from the first vertical axis X1 to an engaged portion of the hole E1*b* with the fixing pin E31 of the fixing plate E1 is bigger than a torque arm from the first vertical axis X1 to an engaged portion X2 of the fixing plate E1 with the connecting member E21, power to require to fix the backrest 7 and the seat 6 can be reduced and the mechanism required to fix the backrest 7 and the seat 6 can be simplified as far as rigidity is given to the fixing pin E31 and the fixing plate E1. Since a rocking movement of the backrest 7 is fixed with a pair of the fixing plates E1 bound mutually, all of the components such as the operating portion or the like except for the connecting member E21 can be equipped in the side of the seat frame 4 and the operating portion can always be arranged at a constant position relative to the seat 6 irrespective of a position of the seat 6 when the seat 6 moves. For a case in which a seated person leaves from the chair and then the backrest 7 moves toward a direction to take an upright posture because of the reacting force mechanism H, the fixing pin E31 receives a pushing force toward a shearing stress from the hole E1*b* of the fixing plate E1, which prevents the fixing pin E31 from being drawn out of the hole E1*b* due to friction force between the fixing pin E31 and the hole E1*b*, thereby to prevent the backrest 7 from a quick movement to take an upright posture. And when the person sits on the chair C again, the above-mentioned pushing force toward a shearing stress disappears, which makes it possible to operate the rocking position adjusting operation lever E5. In addition, since the fun-shaped fixing plate E1 rotates on a level plane, the fixing plate E1 can be designed to be thin. Further, if gears that engage each other are formed on the periphery of the fun-shaped fixing plates E1, slippage can be avoided.

The reactive force adjusting mechanism A is, as shown in FIG. 4, so arranged that the fixed retainer H1 of the coil spring S is held at a fixed position by a shaft-shaped backup member A10 and comprises a third rotating arm A1 that can be rotated around a horizontal axis A11 and that is provided with the backup member A10 and a screw element A2 having a grip A21 that is helically connected with the third rotating arm A1 at a position displaced from the horizontal axis A11 from a direction making a generally right angle to the displaced direction, in which the screw element A2 projects out of the front wall 32 of the supporting base 3 by penetrating the front wall 32 and the grip A21 is arranged at the projected position. When the screw element A2 is helically moved by operating the grip A21, the third rotating arm A1 rotates around the horizontal axis A11 and a backup position of the retainer H1 moves toward a direction so that a compressed pressure of the coil spring S is increased or decreased through the backup member A10. Since a crossed angle of the third rotating arm A1 and the screw element A2 varies in compliance with an operated position, a pressing plate A22 is mounted on a distal end of the screw element A2 and a partially arc-shaped projection A12 is formed for the third rotating arm A1 so as to be able to cope with a variation of the crossed angle by pushing the projection A12 with the pressing plate A22.

Merits of the reactive force adjusting mechanism A are as follows: Since the reactive force adjusting mechanism A can be incorporated inside a longitudinal length of the coil spring S, the reactive force adjusting mechanism A can be downsized in length in comparison with a case in which a reactive force adjusting mechanism is arranged at one end of the coil spring S. Since the coil spring S is arranged in a rearward inclining posture (generally 45 degrees in this embodiment), an overall length of the supporting base 3 that accommodates the coil spring S can be downsized, which makes it possible to secure a sufficient margin to allow the seat 6 to make a sliding movement back and forth by effectively avoiding interference between the seat 6 and the supporting base 3. The grip A21 for operation can be arranged on a front wall of the supporting base 3 which can be accessible. The grip A21 can be operated with ease due to leverage based on an arm length of the third rotating arm A1.

The chair C of this embodiment is completed with the body 1 of the above arrangement on which the seat 6 and the backrest 7 are mounted.

In accordance with the arrangement, the backrest 7 having a following arrangement is mounted on the back frame 5.

Figure 7:
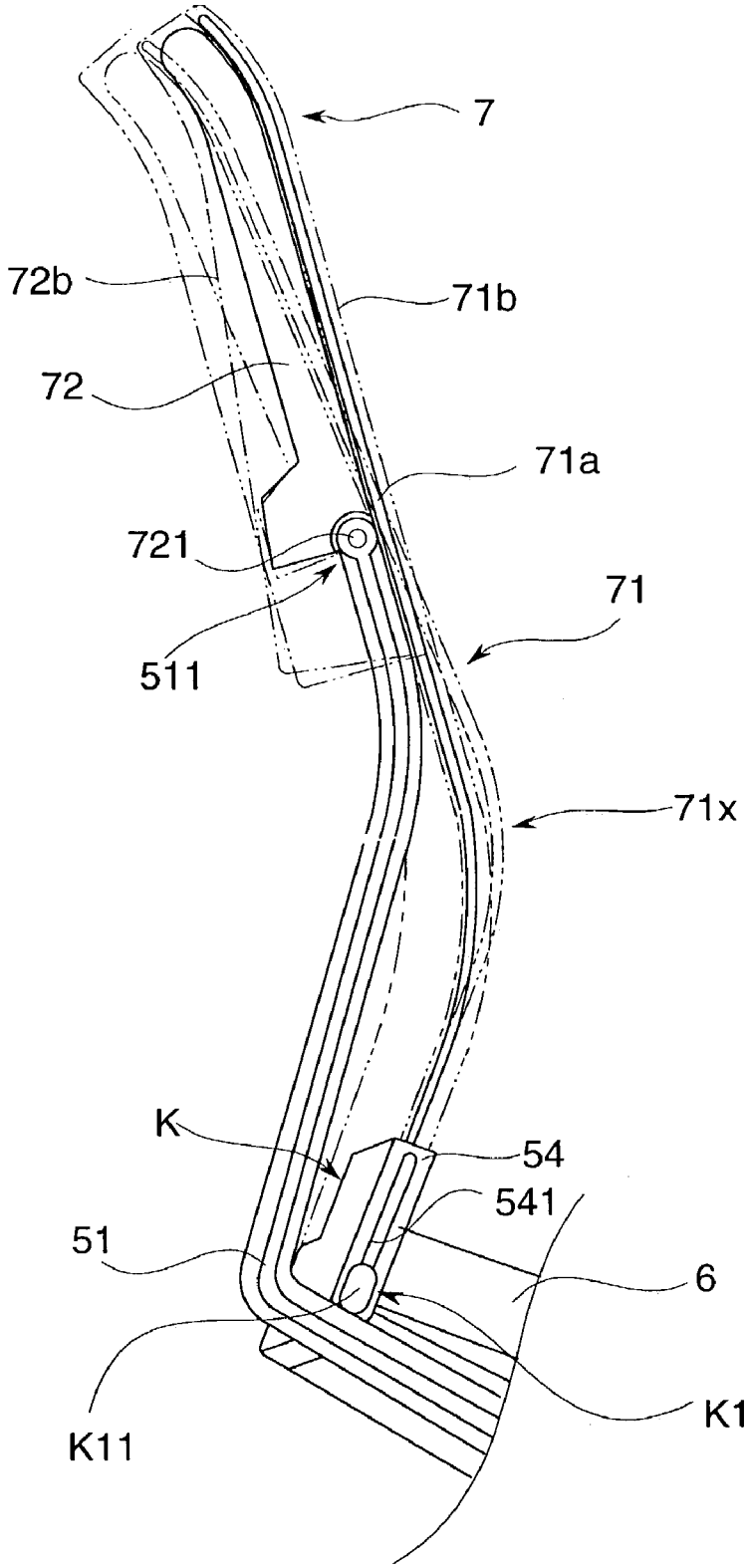
FIG. 7 is a magnified side view in order to explain a transforming movement of a backrest in accordance with the embodiment.
Figure 8:
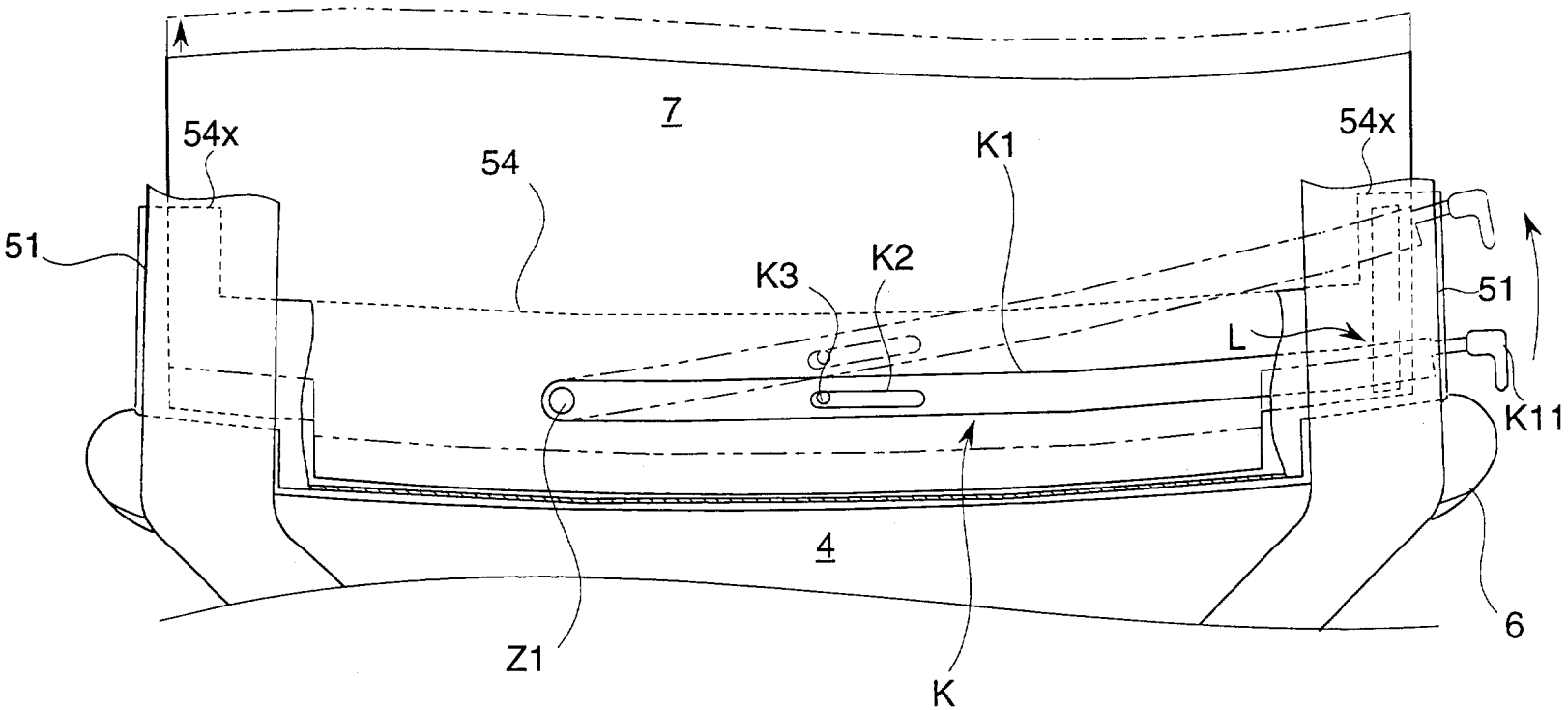
FIG. 8 is a magnified view showing a bottom operating portion of the embodiment.

The backrest 7 comprises, as shown in FIG. 7, FIG. 8 and FIG. 9, a backrest body 71 composed of a hollow core material 71*a* made of elastic material that forms an outer shape of the backrest 7 and an upholstery material 71*b* which is sewn into a bag shape and inside of which the core material 71*a* is accommodated and a backrest upper reinforcing member 72 that is made of a rigid material formed into a downward facing channel shape and that is arranged upper backside of the backrest body 71. The core material 71*a* is formed into a shape wherein a portion which functions as a lumber support portion 71*x* which locates at a little lower than a middle of a height thereof is bent to project forward in a side view. Further a backrest upper supporting portion 511 is formed for a back frame element 51. The backrest upper supporting portion 511 is provided with a pin through hole 511*a*. The pin through hole 511*a* is adjusted to coincide with a pin through hole 72*a*1 provided at a bottom end portion of the backrest upper reinforcing member 72 and then a horizontal pin 721 is inserted into the pin through hole 511*a* and the pin through hole 72*a*1 so that the backrest upper reinforcing member 72 is connected with the backrest upper supporting portion 511 in a rotatable manner through the horizontal pin 721. The bottom end portion of the backrest 7 is supported by a backrest receiving member 54 as a backrest lower supporting portion whose shape is a hollow box opening upward. Channel portions 54*x* facing each other are integrally projected upward at both left and right ends of the backrest receiving member 54 and a side edge of the backrest 7 is inserted in a slidable manner toward an up and down direction into a groove of the channel portion 54*x* and the bottom end portion of the backrest 7 can be inserted from upside into the opening portion of the backrest receiving member 54 at a position in which the backrest 7 is moved downward. The backrest receiving member 54 is provided with a cut-out 54*a* at both right and left ends of the bottom end thereof and the cut-out 54*a* is fixed by being placed near the bent portion 51*b* of the back frame element 51. Further, an upper portion of the backrest body 71 as a top end of the backrest 7 and the backrest upper reinforcing member 72 are covered with common upholstery 72*b*.

More specifically, the backrest 7 is rotated around the pin 511*a* as a horizontal axis of the backrest upper support portion 511 so as to project or depress the lumber support portion 71*x* back and forth or ups and downs in compliance with a position of the bottom end portion of the backrest 7 that is slid vertically.

The projecting or depressing movement is brought about by a backrest form adjusting mechanism K as a bottom operating portion incorporated into a part of the back frame 5.

The backrest form adjusting mechanism K is, as shown in FIG. 3, FIG. 7 and FIG. 8, provided with an operating lever K1 comprising a blade spring as an elastic material one end of which is fixed to a horizontal axis Z1 provided in a general center portion of the backrest receiving member 54 and other end of which is provided with an operating grip K11 after passing through a slit 541 arranged on the channel portion of the backrest receiving member 54, a long hole K2 arranged on the operating lever K1, a pin K3 arranged on the bottom end portion of the backrest body 71 to pass through the long hole K2 and a fixing mechanism that fixes the operating lever K1. When the operating lever K1 is lifted up, the pin K3 makes an abutting contact with the long hole K2, a force acts on the bottom end portion of the backrest body 71 to lift up by means of the pin K3 and the backrest receiving member 54 serves as a guide, thereby to lift up the bottom end portion of the backrest 7 with a horizontal posture kept. A portion that serves as the lumber support portion 71*x* transforms from a shape shown by a solid line in FIG. 7 to a shape shown by an imaginary line in FIG. 7. The backrest receiving member 54 is shown by an imaginary line in FIG. 8. The fixing mechanism is equipped with an appropriate ratchet structure that changes a fixed position at a predetermined pitch wherein a fixed condition is released when operational force is applied and the fixed condition is brought in by making use of the blade spring when operational force is released. An appropriate reinforcing fitting may be attached to the bottom end portion of the backrest body 71 to secure a necessary rigidity for mounting the pin K3, if required.

As mentioned above, in this embodiment the backrest 7 is formed to be transformable and the backrest receiving member 54 as a backrest bottom supporting portion that supports the bottom end portion of the backrest 7 in a slidable manner toward a certain direction and the backrest form adjusting mechanism K as a bottom operating portion that fixes a position at which the bottom end portion of the backrest 7 is slid can be selected and fixed are provided, and the backrest 7 can be transformed in compliance with the position operated by the backrest form adjusting mechanism K.

As mentioned above, since the backrest 7 is given elasticity and a part of the backrest 7 is supported in a slidable manner up and down by the backrest receiving member 54, it is possible to simplify an arrangement to support the backrest 7. Especially, if the backrest 7 is given elasticity, feeling to contact or feeling to use the backrest 7 can be improved, therefore there is no need of furnishing additional arrangement to secure the feeling. As a result, in accordance with this embodiment, a structure that functions as a backrest and a structure that is necessary to transform the backrest 7 can be effectively combined.

Since a sliding movement toward a certain direction is a linear movement and the bottom end portion of the backrest 7 is guided by the channel portion 54*x* of the backrest receiving member 54, the arrangement of the structure to support the backrest 7 can be made very simple and operability can be improved as well. Especially, in this embodiment, the lumber support portion 71*x* not only projects forward but also moves upward simultaneously in compliance with a position adjusted by the backrest form adjusting mechanism K. As a result, if a rear portion of the seat 6 that makes a contact with a pelvic of a seated person is so arranged to move upward in accordance with the above adjustment, a position of the lumber support portion 71*x* relative to a position of lumber of a seated person is equal to a case wherein the lumber support portion 71*x* makes a movement to project forward alone. Then it is significant for a case in which a same personal adjusts a position of the lumber support portion 71*x*. This arrangement is also significant for a case in which a position of the lumber support portion 71*x* is adjusted in compliance with varieties of physical constitutions of a seated person.

It is a matter of course that it is effective to make the position of the lumber support portion 71*x* project or depress back and forth alone in compliance with a position operated by the operating portion.

In accordance with the embodiment, since the backrest body 71 that is curved to form a character "S" transforms itself by changing a degree of a curve smoothly in compliance with a projecting or depressing movement of the lumber support portion 71*x*, it is possible to transform the backrest body 71 so as to tightly attach a back of a seated person, thereby to effectively secure an area supporting the back of the seated person.

Since the backrest 7 comprises the transformable backrest body 71 locating at a position that makes a contact with a back of a seated person and the backrest reinforcing member 72 that is mounted on the back frame 5 and that supports a part of the backrest body 71 from its back side and a portion that is not supported by the backrest reinforcing member 72 is transformed, it is possible to give a function to support a back of a seated person and a transformable function to the backrest 7 without a complicated arrangement.

A second embodiment of the present claimed invention will be described. The same name and the same code will be given to a member corresponding to the first embodiment.

An overall view of a chair in accordance with this embodiment is omitted, and like the chair C in accordance with the first embodiment the chair of this embodiment has an arrangement in which a body 1 as a basis of a structure comprises a leg 2, a supporting base 3 mounted on a top end of the leg 2, a seat frame 4 whose front is supported by the supporting base 3 and a back frame 5 whose proximal end is mounted on the supporting base 3 wherein a rear end of the seat frame 4 is supported by a middle portion thereof and that each of a seat 6 and a backrest 7 is mounted on the seat frame 4 and the back frame 5 of the body 1.

Since an arrangement and a function of the body 1 is the same that of the first embodiment, detailed explanation will be omitted. The chair of this embodiment is completed by mounting the seat 6 and the backrest 7 on the body 1.

In this embodiment the backrest 7 of the following arrangement is mounted on the back frame 5.

Figure 10:
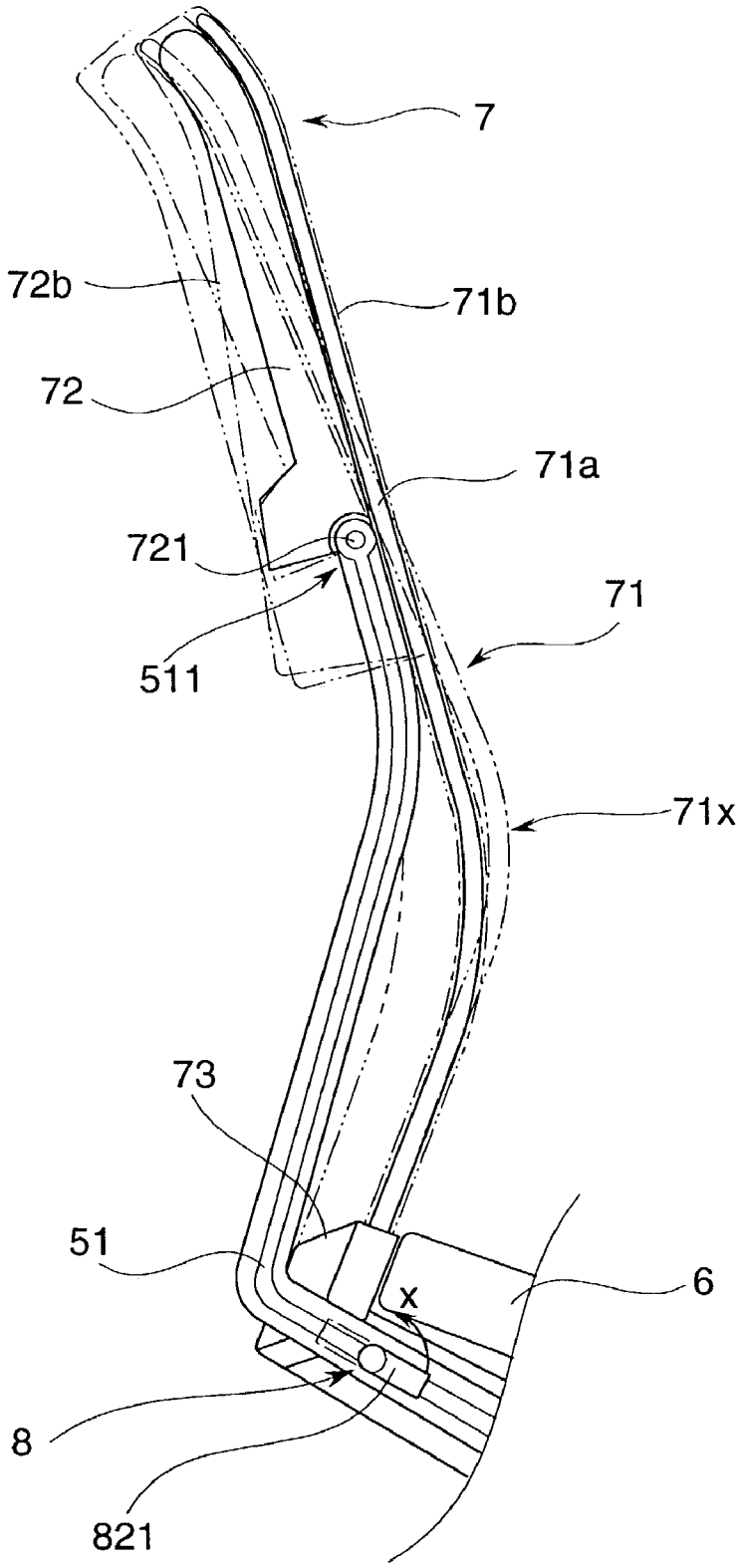
FIG. 10 is a conceptual view showing a mechanism and a movement of the backrest of a chair in accordance with a second embodiment of the invention.
Figure 11:
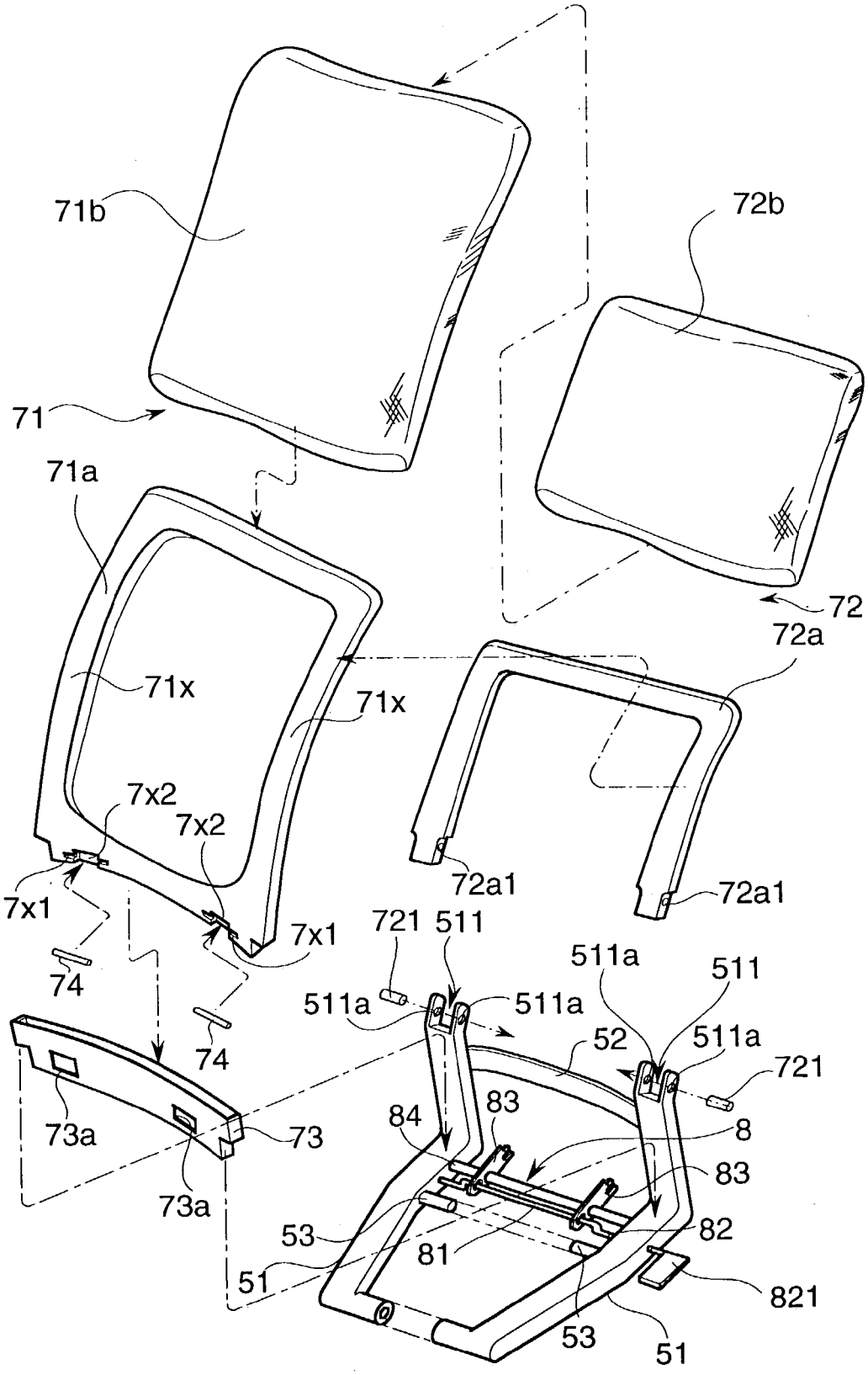
FIG. 11 is an exploded perspective view showing an arrangement of the backrest of the chair in accordance with the embodiment.

The backrest 7 comprises, as shown in FIG. 10 and FIG. 11, a backrest body 71 composed of the hollow core material 71*a* made of elastic material that forms an outer shape of the backrest 7 and an upholstery material 71*b* which is sewn into a bag shape and inside of which the core material 71*a* is accommodated, a backrest upper reinforcing member 72 that is made of a rigid material formed into a downward facing channel shape and that is arranged upper backside of the backrest body 71 and a box-shaped backrest lower reinforcing member 73 that covers the bottom end portion of the backrest body 71. The core material 71*a* is formed into a shape wherein a portion which functions as a lumber support portion 71*x* which locates at a little lower than a middle of a height thereof is bent to project forward in a side view. Further a backrest upper supporting portion 511 is formed for a back frame element 51. A pin through hole 511*a* is provided for the backrest upper supporting portion 511. The pin through hole 511*a* is adjusted to coincide with a pin through hole 72*a*1 provided at a bottom end portion 72*a* of the backrest upper reinforcing member 72 and then a horizontal pin 721 is inserted into the pin through hole 511*a* and the pin through hole 72*a*1 so that the backrest upper reinforcing member 72 is connected with the backrest upper supporting portion 511 in a rotatable manner through the horizontal pin 721. Further, an upper portion of the backrest body 71 as a top end of the backrest 7 and the backrest upper reinforcing member 72 are covered with common upholstery 72*b*.

Figure 12:
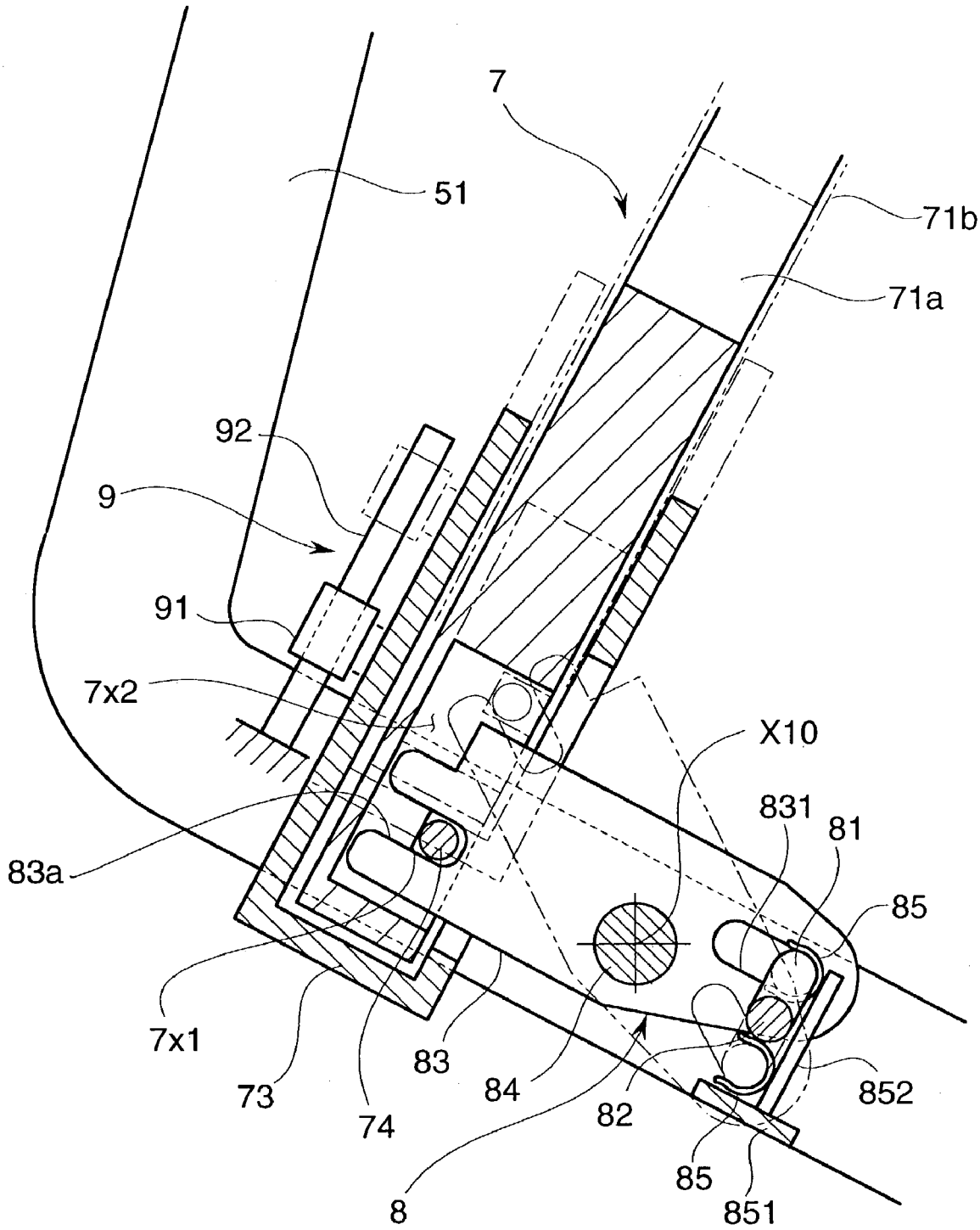
FIG. 12 is a general view showing a crank mechanism of the chair in accordance with the embodiment.

In FIG. 11 an exploded view is shown and in FIG. 12 a longitudinal cross-sectional view of a portion in the vicinity of connecting the backrest 7 is shown, the bottom end portion of the backrest 7 is supported in a slidable manner by a crank mechanism 8 and a guide mechanism 9 and the bottom end portion of the backrest 7 can be moved up and down by the crank mechanism 8. More specifically, the crank mechanism 8 and the guide mechanism 9 serve as a function of the backrest lower supporting portion in collaboration. The crank mechanism 8 also serves as a bottom operating portion.

Concretely, the crank mechanism 8 comprises a crank portion 81, a crank shaft portion 82 one end of which is provided with an operating grip 821 as the bottom operating portion and a crank arm portion 83 one end of which is connected with the crank portion 81. The crank arm 83 can be rotated around a rotational center X10 locating at a middle portion thereof while the other end thereof is connected with the bottom end portion of the backrest 7. The bottom end portion of the backrest 7 can be moved up and down with a rotational operation of the operating grip 821. In this embodiment a pair of crank arm portions 83 are arranged apart right and left.

More specifically, each of the crank portion 81 and the crank shaft portion 82 is made of a single metal bar formed into a bent shape. The crank shaft portion 82 is supported in a rotatable manner by the back frame element 51 and one end thereof is inserted into and passed through one of the back frame elements 51. A long hole 831 into which the crank portion 81 is inserted is arranged at one end portion of the crank arm portion 83 and a through hole through which an axis member 84 is passed is arranged at the rotational center X10. The axis member 84 is arranged to bridge between the back frame elements 51.

Figure 13:
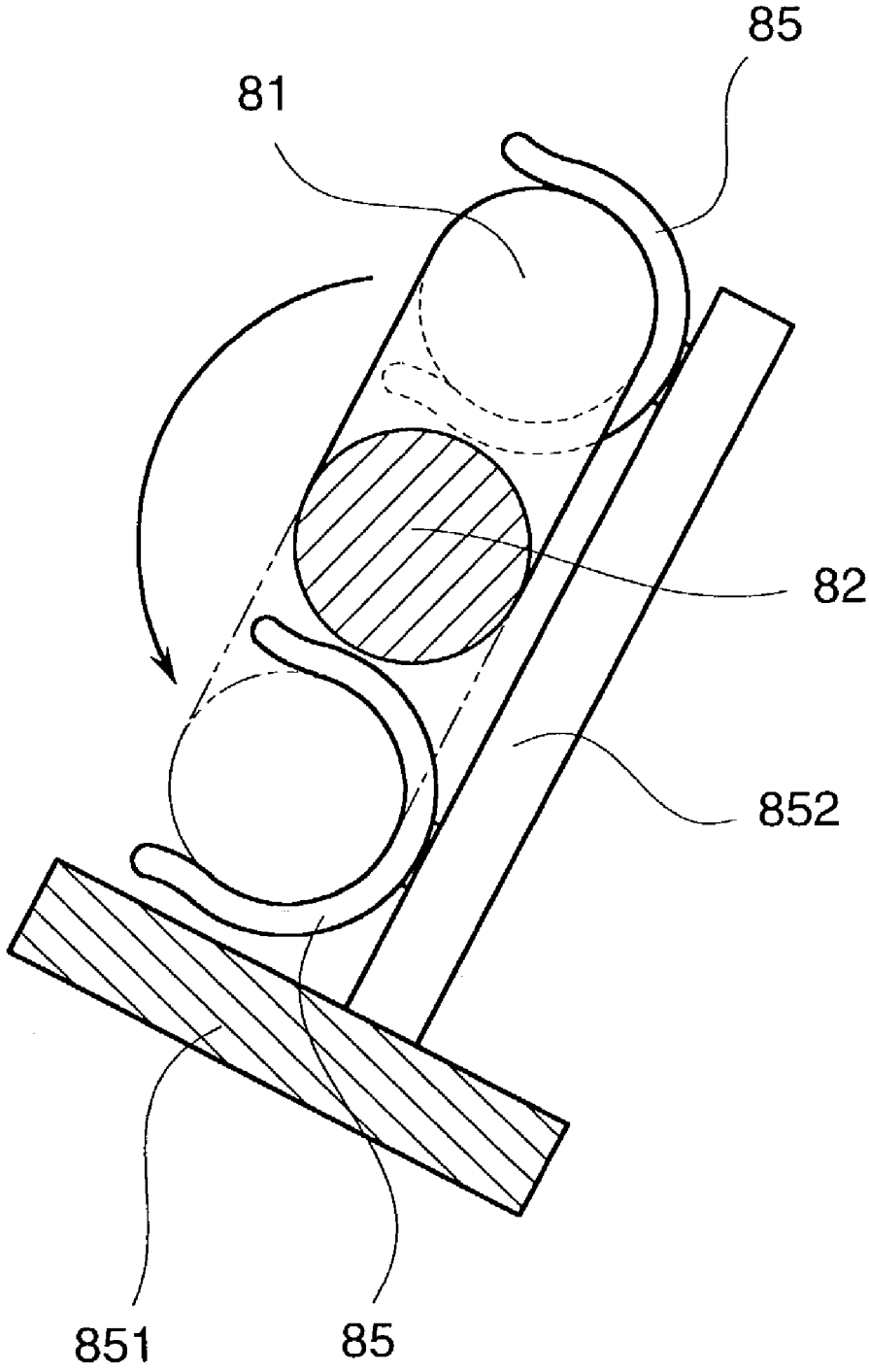
FIG. 13 is a general view showing a stopper of the crank mechanism of the chair in accordance with the embodiment.

Further, a stopper 85 (omitted to draw in FIG. 11) that restricts a traveling range of the crank portion 81 is provided on a path where the crank portion 81 travels. The stopper 85 is made of resin or the like, as shown in FIG. 13, formed in a shape of a character "C" in a cross-sectional view and is mounted on a stopper mounting member 852 upstanding from a stopper plate 851 that bridges the back frame elements 51 with an opening portion of the stopper 85 facing toward a traveling range.

The guide mechanism 9 comprises, as shown in FIG. 12, a slider 91 arranged backside of the backrest lower reinforcing member 73 and a guide member 92 that is fixed to an appropriate position and that extends vertically. The guide mechanism 9 moves the bottom end portion of the backrest 7 up and down in a parallel condition by consistently engaging the slider 91 with the guide member 92. In this embodiment, the slider 91 is cylinder in shape and the guide member 92 is axis in shape.

An engaging member 72 to connect the bottom end portion of the backrest 7 and the crank arm 83 is arranged at the bottom end portion of the backrest 7. An opening portion 83*a* opening rearward is arranged at an opposite end to the long hole 831 of the crank arm portion 83 so as to engage the opening portion 83*a* with an engaging member 74. The engaging member 74 is so arranged to be fitted into the backrest body 71. A crank arm insertion window 73*a* is arranged on a front wall of the backrest lower reinforcing member 73 and the crank arm portion 83 can be inserted through the crank arm insertion window 73*a*. More specifically, an engaging member mounting groove 7*x*1 opening forward is arranged near a bottom edge of the core material 71*a* constituting the backrest 71 so as to insert the engaging member 74 into the engaging member mounting groove 7*x*1 and a crank arm insertion hole 7*x*2 that is smaller than the engaging member mounting groove 7*x*1 in width and larger than the engaging member mounting groove 7*x*1 in height and depth is arranged at a center of a width of the engaging member mounting groove 7*x*1. The backrest lower reinforcing member 73 is mounted on the bottom end portion of the backrest body 71 by overlapping the crank arm insertion window 73*a* with the crank arm insertion hole 7*x*2.

A process to move the bottom end portion of the backrest 7 from a position shown by a solid line to a position shown by an imaginary line in FIG. 10 and FIG. 12 by the use of the above-arranged crank mechanism 8 will be explained.

If an operating grip 821 is rotated 180 degrees toward a direction shown by an arrow x in FIG. 10, the crank portion 81 rotates generally 180 degrees together with the crank shaft 82 from a position where the crank portion 81 projects upward toward the crank shaft portion 82 to a position where the crank portion 81 projects downward to the crank shaft portion 82 and the crank arm portion 83 rotates through an engagement of the long hole 831 and the crank portion 81. Then the engaging member 74 arranged at the bottom end portion of the backrest 7 is lifted up by the opening portion 83*a* of the crank arm portion 83 and then the bottom end portion of the backrest 7 is guided by the guide mechanism 9 from a position shown by a solid line to a position shown by an imaginary line in FIG. 12 so as to slide upward. The stopper 85 is transitionally pushed to open so that the crank portion 81 is accommodated in the stopper and then the bottom end portion of the backrest 7 is kept at the position shown by the imaginary line in FIG. 12.

When the bottom end portion of the backrest 7 moves upward, a portion that serves as the lumber support portion 71*x* projects both forward and upward so that the backrest 7 transforms from a shape shown by a solid line to a shape shown by an imaginary line in FIG. 10.

The bottom end portion of the backrest 7 returns from the position shown by the imaginary line to the position shown by the solid line in FIG. 10 and FIG. 12 with a reverse operation.

As mentioned above, the bottom end portion of the backrest 7 can be fixed selectively at the position shown by the imaginary line or at the position shown by the solid line in FIG. 12 by means of the crank mechanism 8.

As mentioned above, in this embodiment the backrest 7 is formed to be transformable and the crank mechanism 8 and the guide mechanism 9 as a backrest bottom supporting portion that collaboratively supports the bottom end portion of the backrest 7 in a slidable manner toward a certain direction and the operation grip 821 as a bottom operating portion that fixes a position at which the bottom end portion of the backrest 7 is slid can be selected and fixed are provided, and the backrest 7 can be transformed in compliance with the position operated by the operation grip 821.

As mentioned above, since the backrest 7 is given elasticity and the bottom end portion of the backrest 7 is supported by the crank mechanism 8 and the guide mechanism 9 in a slidable manner, it is possible to simplify an arrangement to support the backrest 7. Like the first embodiment, since the backrest 7 is given elasticity, feeling to contact or feeling to use the backrest 7 can be improved. Then there is no need of furnishing additional arrangement to secure the feeling. As a result, in accordance with this embodiment, like the first embodiment, a structure that functions as a backrest 7 and a structure that is necessary to transform the backrest 7 can be effectively combined.

Since a sliding movement toward a certain direction is a linear movement and the bottom end of the backrest 7 is guided by the guide mechanism 9 comprising the slider 91 arranged at a back side of the backrest lower reinforcing member 73 and the guide member 92 that is always engaged with the slider 91 and that is fixed at an appropriate position, it is possible to move the backrest 7 in a parallel manner with an extremely simple arrangement. Further, since operation can be made by the use of the operation grip 821, it is possible to transform the backrest 7 with ease. Especially, in this embodiment, the lumber support portion 71*x* not only projects forward but also moves upward simultaneously in compliance with a position of the operation grip 821 of the crank mechanism 8. As a result, if a pelvic locating a rear portion of the seat 6 is so arranged to move upward in accordance with the above adjustment, a position of the lumber support portion 71*x* relative to a position of lumber of a seated person is equal to a case wherein the lumber support portion 71*x* makes a movement to project forward alone. Then it is significant for a case in which a same personal adjusts a position of the lumber support portion 71*x*. This arrangement is also significant for a case in which a position of the lumber support portion 71*x* is adjusted in compliance with varieties of physical constitutions of a seated person.

The same effect as that is described in the first embodiment will be obtained in the second embodiment.

Figure 14:
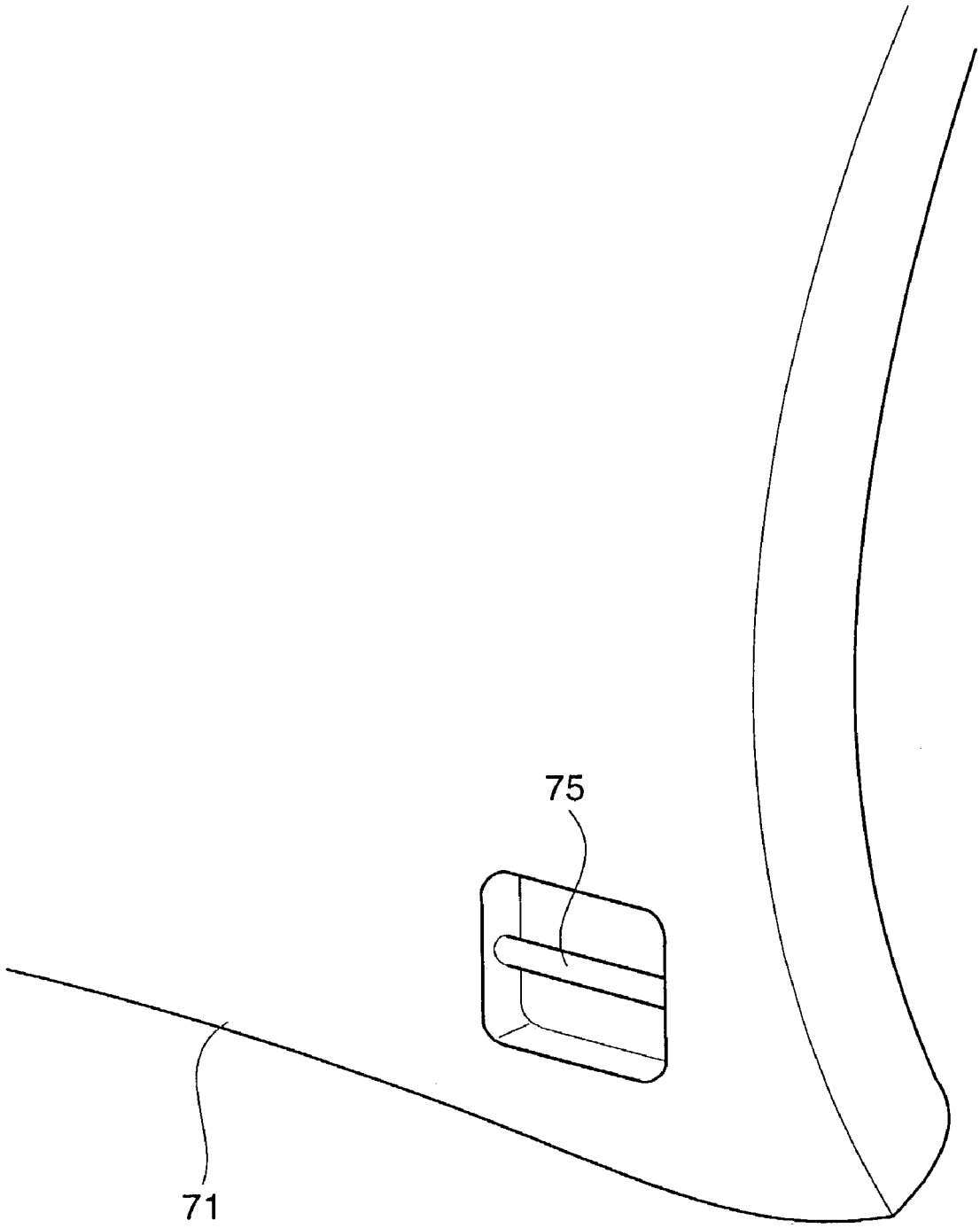
FIG. 14 is a view showing a modification of the embodiment.

Instead of the above-mentioned engaging member 74, for example, an engaging member 75, as shown in FIG. 14, made of resin integrally formed into the backrest body 71 may be used. Instead of the above-mentioned guide mechanism 9 comprising the slider 91 and the guide member 92, the guide mechanism may comprise an axial shaped slider extending vertically that is arranged backside of the backrest lower reinforcing member and a cylindrical guide member that is fixed at an appropriate position wherein the slider and the guide member are always engaged.

Each of the above arrangements is not limited to the above embodiments.

Figure 15:
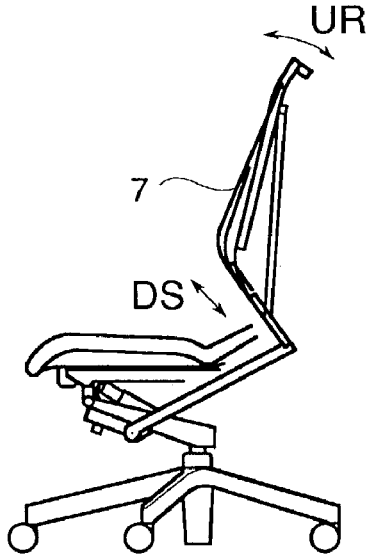
FIG. 15 is a diagram showing a modification of the invention.

For example, a sliding movement may be varied. FIG. 15 is a diagram showing the above embodiment in which the top end portion of the backrest 7 is supported in a rotatable manner around a horizontal axis as shown by an arrow UR and the bottom end portion of the backrest 7 is supported in a linearly slidable manner as shown by an arrow DS by a backrest bottom supporting portion, not shown in drawings, and can be selected and fixed a sliding position by a bottom operating portion, not shown in drawings. More specifically, when the bottom end portion of the backrest 7 is lifted up, the backrest 7 is compressed between the top end portion and the bottom end portion thereof, which transforms the backrest 7 transforms, as a result whole of the backrest 7 bulges forward. At this time the top end portion of the backrest 7 rotates around the horizontal axis to incline rearward. The backrest 7 transforms reversely with a reversed operation.

Figure 16:
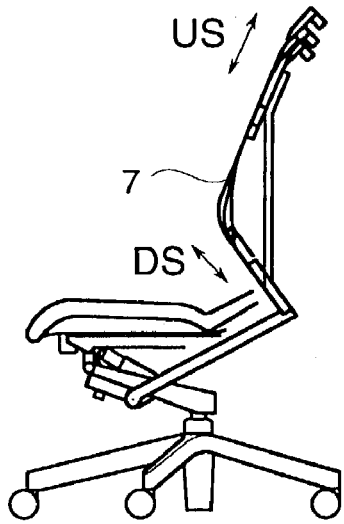
FIG. 16 is a diagram showing a modification of the invention.

FIG. 16 is a diagram in which the bottom end portion of the backrest 7 is supported in a linearly slidable manner as shown by an arrow DS by a backrest bottom supporting portion, not shown in drawings, and a position at which the bottom end portion of the backrest 7 is slid can be selected and fixed by a bottom operating portion, not shown in drawings, and the top end portion of the backrest 7 is supported in a linearly slidable manner as shown by an arrow US by a backrest top supporting portion, not shown in drawings, and a position at which the top end portion of the backrest 7 is slid can be selected and fixed by a top operating portion, not shown in drawings. In accordance with the arrangement, when the bottom end portion of the backrest 7 is lifted up with the backrest top supporting portion fixed, the top end portion of the backrest 7 keeps its position or moves a little upward to follow a movement of the bottom end portion of the backrest 7, then the backrest 7 is compressed so as to bulge forward. In case that the top end portion of the backrest 7 is pushed down with the backrest bottom supporting portion fixed, the bottom end portion of the backrest 7 keeps its position or move a little downward to follow a movement of the top end portion of the backrest 7, then the backrest 7 is compressed, as a result the backrest 7 bulges forward. In case the bottom end portion of the backrest 7 is lifted up and the bottom end portion of the backrest 7 is pushed down simultaneously, the backrest 7 transforms to bulge forward considerably.

Figure 17:
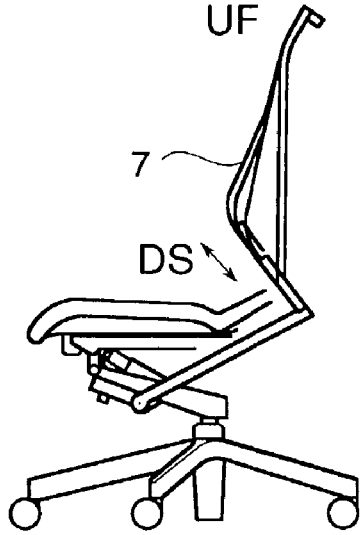
FIG. 17 is a diagram showing a modification of the invention.

FIG. 17 is a diagram in which the bottom end portion of the backrest 7 is supported in a linearly slidable manner as shown by an arrow DS by a backrest bottom supporting portion, not shown in drawings with the top end portion of the backrest 7 fixed (UF), and a position at which the bottom end portion of the backrest 7 is slid can be selected and fixed by a bottom operating portion, not shown in drawings. In accordance with the arrangement, the backrest 7 transforms as the same as a case in which the backrest bottom supporting portion is lifted up with the backrest top supporting portion fixed shown in FIG. 16.

Figure 18:
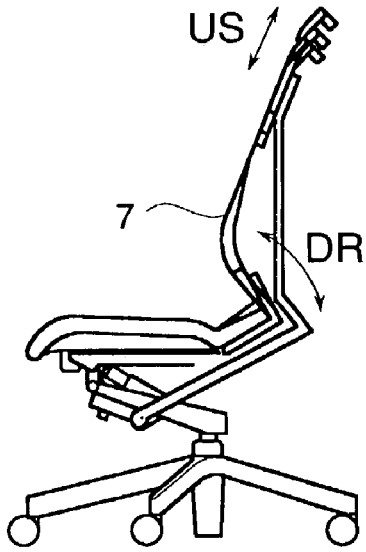
FIG. 18 is a diagram showing a modification of the invention.

FIG. 18 is a diagram in which the bottom end portion of the backrest 7 is supported in a rotatable manner around the horizontal axis as shown by an arrow DR and the top end portion of the backrest 7 is supported in a linear slidable manner as shown by an arrow US by the backrest top supporting portion, not shown in drawings, and a position at which the top end portion of the backrest 7 is slid can be selected and fixed by a top operating portion, not shown in drawings. In accordance with the arrangement, the backrest 7 transforms in a reversed manner shown in FIG. 15.

Figure 19:
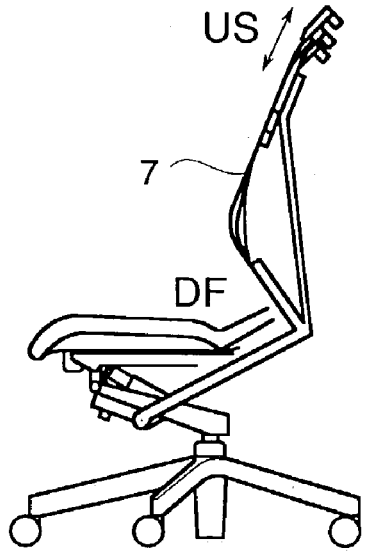
FIG. 19 is a diagram showing a modification of the invention.
Figure 20:
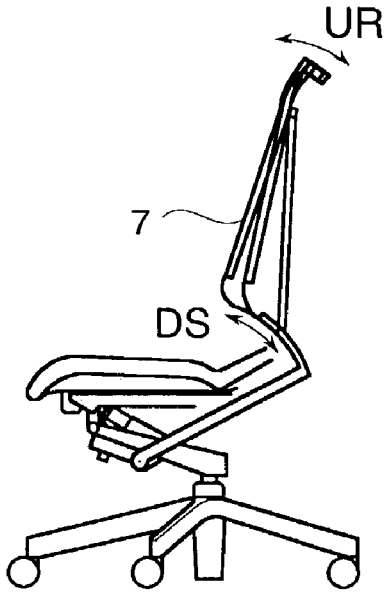
FIG. 20 is a diagram showing a modification of the invention.
Figure 21:
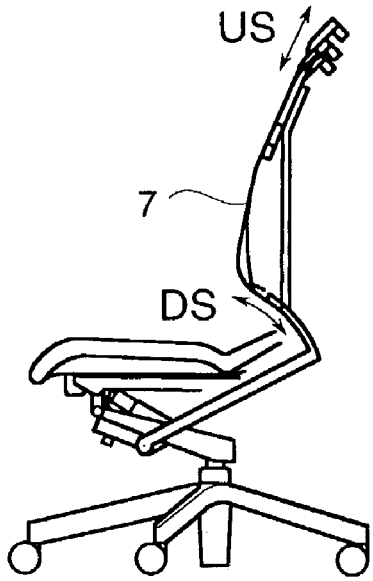
FIG. 21 is a diagram showing a modification of the invention.
Figure 22:
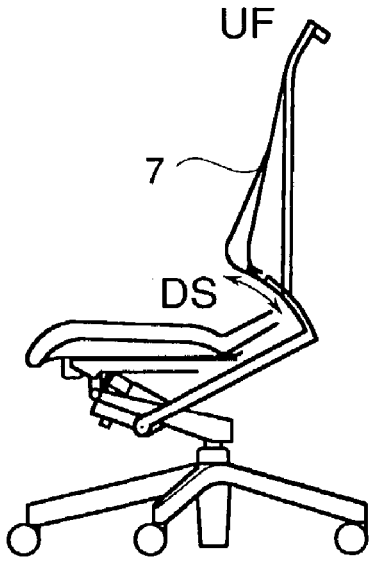
FIG. 22 is a diagram showing a modification of the invention.
Figure 23:
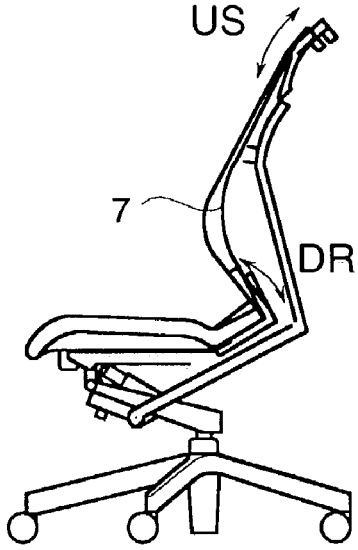
FIG. 23 is a diagram showing a modification of the invention.

FIG. 19 is a diagram in which the top end portion of the backrest 7 is supported in a linearly slidable manner as shown by an arrow US by a backrest top supporting portion, not shown in drawings with the bottom end portion of the backrest 7 fixed (DF), and a position at which the top end portion of the backrest 7 is slid can be selected and fixed by a top operating portion, not shown in drawings.

The sliding movement shown in FIG. 15, FIG. 16, FIG. 17 and FIG. 18 is a linear sliding movement, but it may be an arc sliding movement guided along a direction of an arc. Each of FIG. 20, FIG. 21, FIG. 22 and FIG. 23 shows a diagram respectively, in which a linear sliding movement is substituted by an arc sliding movement in FIG. 15, FIG. 16, FIG. 17 and FIG. 18.

In accordance with the above arrangement, the backrest 7 comprises the hollow core material and the bag-shaped upholstery, but the core material may be solid and platy.

The other arrangement of the component is not limited to the embodiment described in drawings and there may be various modifications without departing from the spirit of the invention.

Figure 24:
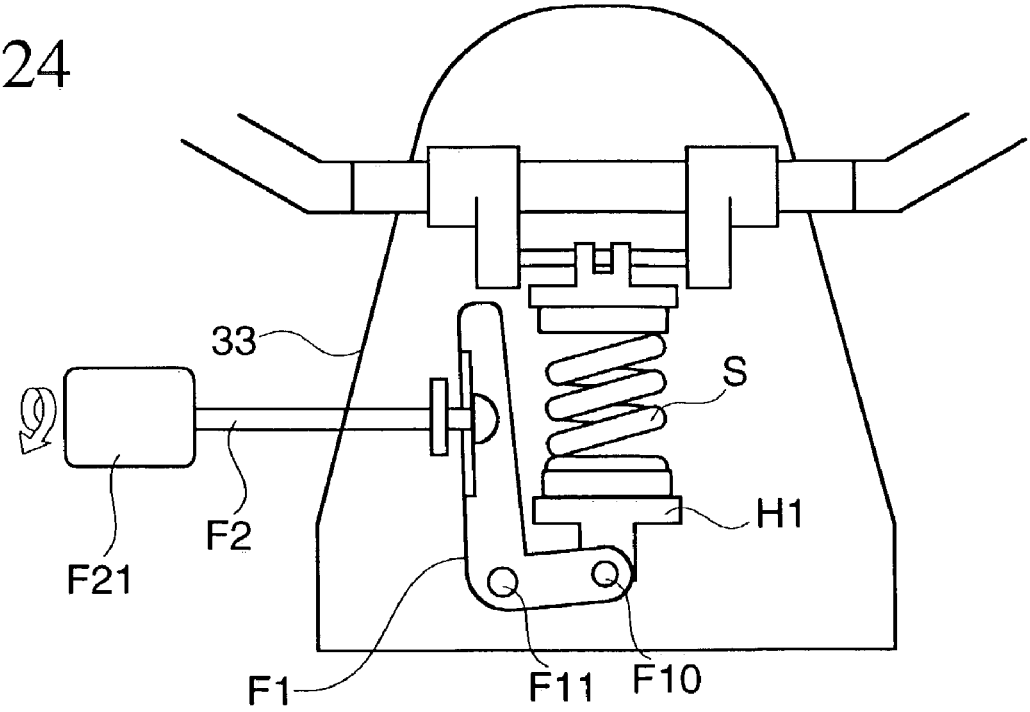
FIG. 24 is a view showing a modification of the above embodiment.

For example, FIG. 24 shows a reactive force adjusting mechanism F as a modified form. The reactive force adjusting mechanism F is so arranged that a fixed retainer H1 of a coil spring S is held at a fixed position by a shaft-shaped backup member F10 and comprises a rotating arm F1 that is provided with the backup member F10 and that can be rotated around a vertical axis F11 and a screw element F2 having a grip F21 that is helically connected with a rotating arm F1 at a position displaced from the vertical axis F11 from a direction making a generally right angle to the displaced direction, in which the screw element F2 projects out of the side wall 33 of the supporting base 3 by penetrating the side wall 33 and the grip F21 is arranged at the projected position. When the screw element F2 is helically moved by operating the grip F21, the rotating arm F1 rotates around the vertical axis F11 and a backup position of the retainer H1 moves toward a direction so that a compressed pressure of the coil spring S is increased or decreased through the backup member F10.

In accordance with the arrangement, a length of a portion that makes a right angle to the bottom wall 31 of the supporting base 3 can be reduced, thereby to make a thickness of the supporting base 3 and its surrounding.

In accordance with the present claimed invention, the backrest can effectively be transformed with a simple arrangement. As a result, this arrangement can preferably be adopted for a chair in which a backrest is required to transform in order to meet various needs, especially for a simple-type chair.

The invention claimed is:

1. A chair comprising a backrest having a backrest body comprising a hollow core material made of elastic material forming an outer share of the backrest and surrounded by an upholstery material, the backrest body further comprising an upper reinforcing member comprising a rigid material shaped as a downward facing channel and arranged at an upper backside of the backrest body, wherein the backrest is transformable, the backrest further comprising a lumbar support portion, an upper portion above the lumbar support portion and supported by the upper reinforcing member, and a lower portion between the lumbar support portion and a bottom end of the backrest wherein the lumbar support portion that is not supported by the upper reinforcing member can be transformed, and the lumbar support portion is bent to project forward to provide lumbar support;

a backrest supporting portion for supporting the lower portion of the backrest in a slidable manner, wherein the lower portion slides in a slanted upward and forward direction; and an operating portion that selects and fixes a position A at which the backrest is slid, wherein the upper portion of the backrest is supported in a rotatable manner around a horizontal axis or in a slidable manner and the backrest can be transformed in compliance with the position A fixed by the operating portion, wherein the backrest supporting portion further comprises a guide mechanism for guiding the lower portion of the backrest in a linearly slidable manner in a slanted upward and forward direction perpendicular to the thickness direction of the lower portion, wherein when sliding, the lower portion of the backrest does not transform and remains oriented in the same direction.

2. The chair described in claim 1 wherein the portion of the backrest above the lumbar support portion is supported in a rotatable manner around a horizontal axis, and the lower portion of the backrest is supported in a slidable manner by a backrest bottom supporting portion and a position B at which the lower portion of the backrest is slid can be selected and fixed by a bottom operating portion.

3. The chair described in claim 1 wherein the lower portion of the backrest is supported in a slidable manner by a backrest bottom supporting portion and a position B at which the lower portion of the backrest is slid can be selected and fixed by a bottom operating portion, and the upper portion of the backrest is supported in a slidable manner by a backrest top supporting portion and a position C at which the top end portion of the backrest is slid can be selected and fixed by a top operating portion.

4. The chair described in claim 1 wherein the upper portion of the backrest is fixed and the lower portion of the backrest is supported in a slidable manner by a backrest bottom supporting portion and a position B at which the bottom end portion of the backrest is slid can be selected and fixed by a bottom operating portion.

5. The chair described in claim 1 wherein a sliding movement is a movement along a line at a right angle to a width of the backrest.

6. The chair described in claim 1 wherein the backrest transforms with the position of the lumber support portion projected or depressed back and forth in compliance with the position operated by the operating portion.

7. The chair described in claim 1 wherein the backrest transforms with the position of the lumber support portion projected or depressed back and forth or up and down in compliance with the position operated by the operating portion.

8. The chair described in claim 1 wherein the backrest transforms its shape smoothly in compliance with the position operated by the operating portion.

9. The chair described in claim 7 wherein the backrest transforms its shape smoothly in compliance with the position operated by the operating portion.

10. The chair described in claim 8 wherein the backrest comprises a transformable backrest body that locates at a position D that contacts a back of a seated person and a backrest reinforcing member that supports a part of the backrest body from its back side and a portion that is not supported by the backrest reinforcing member can be transformed.

* * * * *

UNITED STATES PATENT AND TRADEMARK OFFICE

CERTIFICATE OF CORRECTION

PATENT NO. : 7,134,722 B2
APPLICATION NO. : 10/340638
DATED : November 14, 2006
INVENTOR(S) : Nobuyuki Ueda et al.

It is certified that error appears in the above-identified patent and that said Letters Patent is hereby corrected as shown below:

Column 14, Claim 1, Line 49:
Please replace "share" with --shape--

Signed and Sealed this

Twenty-seventh Day of March, 2007

JON W. DUDAS
*Director of the United States Patent and Trademark Office*